United States Patent [19]

Cutler

[11] Patent Number: 5,050,761

[45] Date of Patent: Sep. 24, 1991

[54] DOUBLE WALL EXTRUSION FOR CONTAINER COVERS

[75] Inventor: Luann J. Cutler, Crestview, Fla.

[73] Assignee: The United States of America as represented by the Scretary of the Air Force, Washington, D.C.

[21] Appl. No.: 528,513

[22] Filed: May 15, 1990

[51] Int. Cl.[5] ..... B65D 43/00; B65D 45/00

[52] U.S. Cl. ..... 220/200; 220/1.5; 220/315

[58] Field of Search ..... 220/200, 668, 627, 1.5, 220/554, 555, 352, 215, 445, 315

[56] References Cited

U.S. PATENT DOCUMENTS 2,086,747 7/1937 Stetson ..... 220/627

2,764,314 9/1956 Mautner ..... 220/668

*Primary Examiner*—Stephen P. Garbe

*Assistant Examiner*—Paul Schwarz

*Attorney, Agent, or Firm*—Bobby D. Scearce; Donald J. Singer

[57] ABSTRACT

A shipping container cover structure is described which comprises side and end wall elements welded at corresponding first and second ends into a rectangular configuration, each of the end and side elements comprising a substantially hollow extruded wall structure including parallel spaced inner and outer walls, side walls substantially closing a space between the inner and outer walls and at least one web interconnecting the inner and outer walls intermediate the side walls and extending along the length of the inner and outer walls for providing structrual support to the inner and outer walls, and a top plate attached to the rectangular configuration along corresponding first sides of the end and side elements.

3 Claims, 2 Drawing Sheets

DOUBLE WALL EXTRUSION FOR CONTAINER COVERS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to shipping container structures, and more particularly to a container cover structure utilizing extruded metallic construction.

In recent years, large containers designed for military use have used aluminum extrusion technology. These containers have proved to be more cost effective than equivalent steel containers. The aluminum extrusions used have included standard structural shapes (I-beams, channels and angles) and custom profiles for bottom sidewalls interfacing the container base. Existing container cover sidewall structures have essentially been limited to modified channel shapes, which have proved sufficient for cover heights of no more than about six inches. Taller covers can be made by stacking and welding two or more channel shapes and plates, or by increasing both height and thickness of existing modified channel profiles, all of which require extra reinforcing for structural strength and rigidity and require excessive fabrication operations.

The invention provides a double-walled metallic extrusion structure for container covers to replace the conventional channel-type extrusion for container walls. Containers constructed according to these teachings may exhibit substantially greater strength and may provide substantial improvement in performance and technical and aesthetic qualities in large metallic containers for military and industrial use.

It is therefore a principal object of the invention to provide an improved shipping container structure.

It a further object of the invention to provide a shipping container cover structure having improved stacking strength using extruded metal construction.

These and other objects of the invention will become apparent as a detailed description of representative embodiments proceeds.

SUMMARY OF THE INVENTION

In accordance with the foregoing principles and objects of the invention, a shipping container cover structure is described which comprises side and end wall elements welded at corresponding first and second ends into a rectangular configuration, each of the end and side elements comprising a substantially hollow extruded wall structure including parallel spaced inner and outer walls, side walls substantially closing a space between the inner and outer walls and at least one web interconnecting the inner and outer walls intermediate the side walls and extending along the length of the inner and outer walls for providing structural support to the inner and outer walls, and a top plate attached to the rectangular configuration along corresponding first sides of the end and side elements.

DESCRIPTION OF THE DRAWINGS

The invention will more be clearly understood from the following detailed description of representative embodiments thereof read in conjunction with the accompanying drawings wherein.

DETAILED DESCRIPTION

Figure 1:
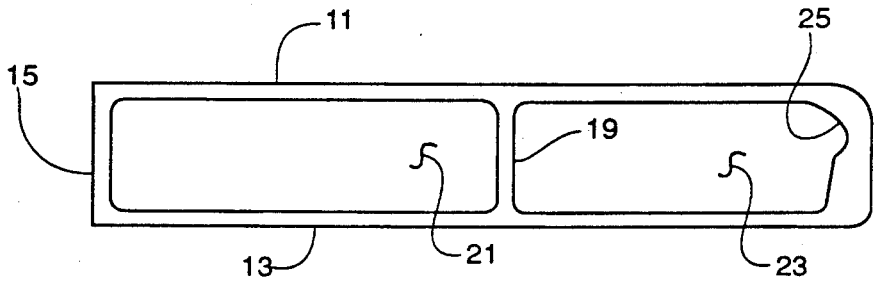
FIG. 1 shows a cross section of a typical double wall extrusion useful in fabricating a container cover of the invention.

Referring now to the drawings, FIG. 1 shows a cross section of a typical double wall extrusion 10 construction useful in the fabrication of a container cover of the invention. It is noted at the outset that extrusions 10 used in container covers built in demonstration of the invention comprises extruded aluminum, although other extrudable metals and alloys may be used in contemplation of the invention such as brass, copper and mild steel. Extrusion 10 comprises an outer wall 11 and inner wall 13 parallel to and spaced from outer wall 11. End wall 15 comprises the top of a side wall structure utilizing extrusion 10, and thicker end wall 17 is suitably shaped to mate with the upstanding wall members of a mating container base structure (not shown). Web 19 disposed between end walls 15,17 and extending between walls 11, 13 provides needed structural strength and rigidity for a container cover constructed of extrusion 10, and forms two cavities 21,23 to accommodate container features and accessories described in more detail below. The particular extrusion 10 structure depicted in FIG. 1 is 9.0 inches long by 1.25 inches thick to accommodate a specific container design, with walls 11,13,15 and web 19 thicknesses at 0.125 inch to provide good weldability. The portion of extrusion 10 from web 19 to wall 15 may, however, be machined off to accommodate a shorter (3.88 inches in the FIG. 1 embodiment) container cover. As is apparent upon a reading hereof, size is not a limiting feature of a container cover structured according to the invention. Cover extrusion structures according to the invention may range in size to about 25 inches high by 1.5 inches thick utilizing wall (extrusion) thicknesses of about 0.080 to 0.150 inches. At the thicker end wall 19, a radius 25 (0.300 inch in the FIG. 1 embodiment) may be provided in order to accommodate container latches, and is positioned in a fabricated container cover to provide optimum closure alignment between the latches, container cover and base.

Figure 2:
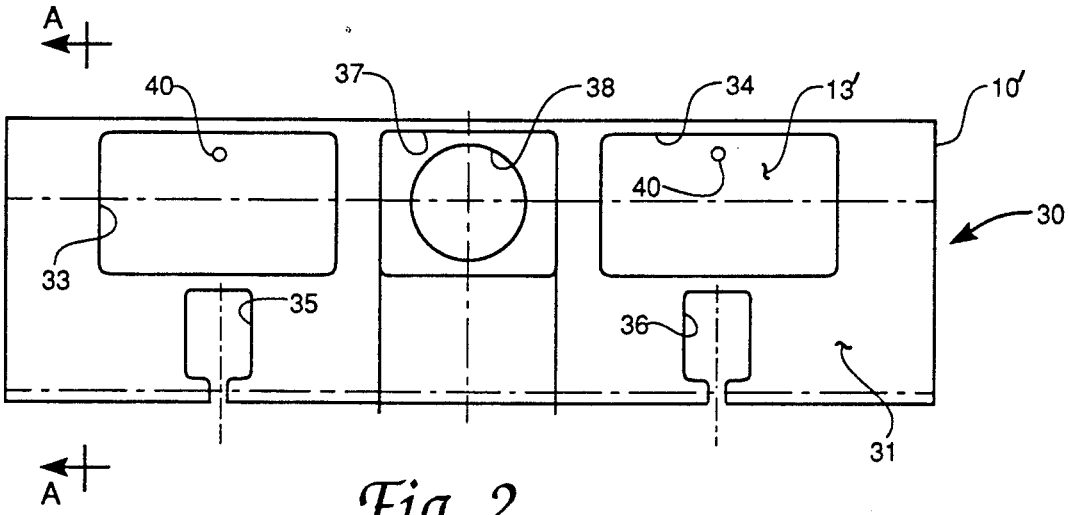
FIG. 2 shows a view in elevation of a representative container cover end wall element constructed of an extrusion of FIG. 1.

Referring now to FIG. 2, shown therein is a view in elevation of a representative container cover end wall element 30 constructed of an extrusion 10 of FIG. 1. It may be noted that a view taken along lines A—A of FIG. 2 is the sectional view of FIG. 1. Wall element 30 therefore comprises an outer wall 31 of the constituent extrusion 10 , corresponding to outer wall 11 of extrusion 10 of FIG. 1 and providing suitable outer surface qualities for the container cover of the invention. Utilizing an extrusion 10' of structure substantially as that shown in FIG. 1 in the fabrication of wall element 30 allows for the accommodation of cutouts in outer wall 31 such as shown at 33,34,35,36; these cutouts provide protected recesses for latches, handles and the like while preserving intact the integrity of inner wall 13' of the extrusion. A cover constructed utilizing wall element 30 may, if necessary, therefore allow a hermetic seal for a container base attached thereto. Cutout 37 may be provided in wall 31 to provide a similarly protected recess for accommodating a port 38 in inner wall 13' for insertion of desiccant or the like through wall element 30. Cutouts 33,34 may also provide suitable protected access to inner wall 13' for one or more ports and fittings 39 permitting leak detection, cover gas insertion or the like.

Figure 3:
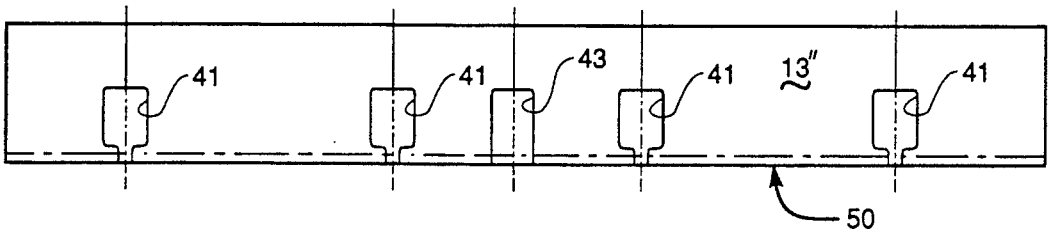
FIG. 3 shows a view in elevation of a representative side wall element constructed of an extrusion of FIG. 1.

Referring now to FIG. 3, shown therein is a view in elevation of a representative side wall element 40 constructed of an extrusion 10 of FIG. 1 and configured in the particular embodiment shown to attach to end wall elements 30 of FIG. 2 to form a cover which was fabricated in demonstration of the invention. A suitable number of cutouts 41 in outer wall 13'' may provide protect recesses for latches and handles in identical manner as cutouts 35,36 of FIG. 2, and one or more cutouts 43 may be sized to accommodate lifting devices.

Figure 4A:
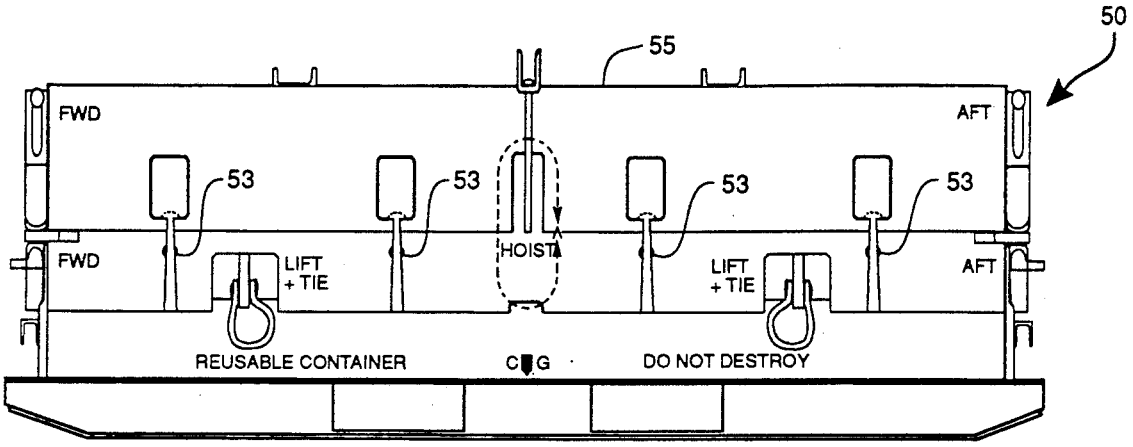
FIGS. 4*a* and 4*b* respectively show front and side views of a representative cover of the invention fabricated using pairs of end wall elements and side wall elements of FIGS. 2 and 3.
Figure 4B:
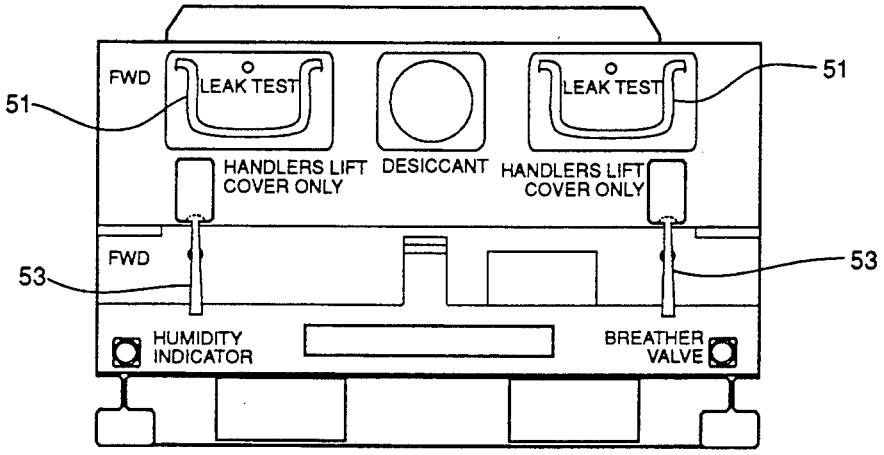

A pair of end wall elements such as that shown at 30 in FIG. 2 and a pair of side wall elements such as that shown at 40 in FIG. 3 may be assembled and welded at corresponding ends to form a rectangular container cover such as shown at 50 in the front and side views of FIGS. 4*a* and 4*b*. Pivoting cover handles 51 and latches 53 may be provided at a plurality of suitable locations on either end and side in recesses 33,34,35,36 (FIG. 2) thereby Providing an outer surface for cover 50 substantially free of protrusions and suitable for attachment of required markings and labels. The side and end wall elements 30,40 may be welded or brazed utilizing conventional techniques and equipment. Top cover element 55, which may comprise a metallic (e.g. aluminum) plate, may be welded to the assembly of end and side elements 30, 40 to complete the closure of cover 50. A substantial advantage of the extruded wall construction which characterizes the invention herein is the facility with which assembly by welding may be performed on both the inside and outside of cover 50 which effectively ensures seal integrity and structural strength of the assembly; individual welds do not require penetration to the point of burnthrough, which decreases the risk of leaky weld joints. As would occur to the skilled artisan practicing the invention, reinforcing gussets (not shown) may be included in the assembly of cover 50 for additional structural strength.

Figure 5:
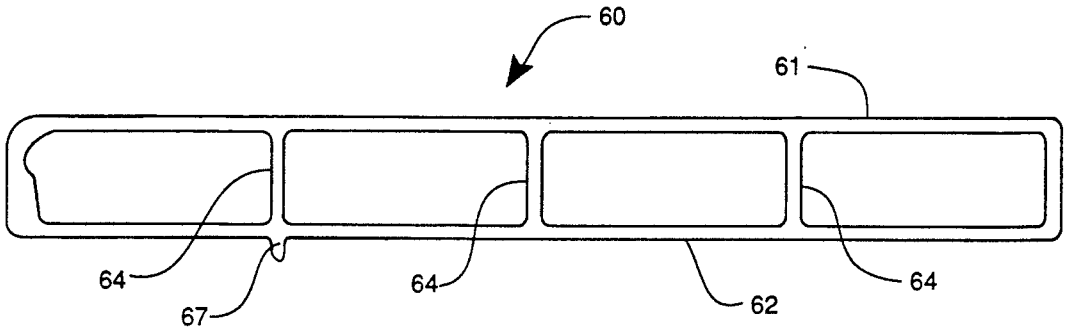
FIG. 5 shows an alternative extrusion configuration to that shown in FIG. 1 having substantially greater overall length.

Referring now to FIG. 5, shown is an alternative extrusion configuration 60 having inner and outer walls 61,62 of substantially greater overall length (i.e. about 16 inches) than that of extrusion 10 of FIG. 1. As is apparent, a greater number of webs 64 are included to provide needed structural integrity. The additional webs also allow cutting of extrusion 60 to various other selected sizes. Protrusion 67 on inner surface 62 may be included to retain cushions within the cover assembly without using adhesives.

The extruded double wall structure of the container cover constructed according to the teachings hereof therefore provides substantial column strength for container stacking and effectively eliminates the need for internal reinforcing characteristic of conventional channel type container wall structures required to prevent deformation at container corners, along horizontally disposed flanges and of vertical container walls, all of which can degrade the integrity of any seal provided between the cover and container base.

The invention therefore provides a novel shipping container cover structure utilizing extruded metal construction. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A shipping container cover comprising:

(a) first and second rectangular end elements and first and second rectangular side elements each having first and second ends arranged and welded at corresponding said first and second ends into a rectangular cover configuration;

(b) each of said end and side elements comprising a substantially hollow extruded wall structure including:

(ii) side walls along said first and second sides, said side walls substantially closing a space between said inner and outer walls;

(iii) at least one web interconnecting said inner and outer walls intermediate said side walls and extending along said space between said inner and outer walls from said first end to said second end thereof, said at least one web separating said space into a plurality of chambers defined between said inner and outer walls and providing structural support to said inner and outer walls; and (c) a top plate attached to said rectangular configuration along corresponding first sides of said end and side elements.

2. The cover of claim 1 wherein said extruded wall structure comprises a metallic material selected from the group consisting of aluminum, brass, copper and mild steel.

3. The cover of claim 1 wherein the side walls along said second sides of said end and side elements have shape preselected to attach to a container base.

* * * * *

UNITED STATES PATENT AND TRADEMARK OFFICE

CERTIFICATE OF CORRECTION

PATENT NO. : 5,050,761

DATED : September 24, 1991

INVENTOR(S) : Luann J. Cutler

It is certified that error appears in the above-identified patent and that said Letters Patent is hereby corrected as shown below:

Column 2, line 65, "10" should read --- 10' ---.
Column 3, line 34, "Providing" should not be capitalized.
Column 4, line 36, the following paragraph should precede "(ii)".

--- (i) parallel spaced inner and outer walls having first and second ends and first and second sides thereof; ---

Signed and Sealed this

Twelfth Day of January, 1993

*Attest:*

*Attesting Officer*

DOUGLAS B. COMER

*Acting Commissioner of Patents and Trademarks*